United States Patent [19]

Altilio

[11] 4,320,681

[45] Mar. 23, 1982

[54] ELECTROMAGNETIC PICKUP DEVICE

[75] Inventor: Michael Altilio, New York, N.Y.

[73] Assignee: DiMarzio Musical Instrument Pickups, Inc., Staten Island, N.Y.

[21] Appl. No.: 123,968

[22] Filed: Feb. 25, 1980

[51] Int. Cl.[3] ..... G10H 3/00; H04R 13/02

[52] U.S. Cl. ..... 84/1.15; 84/1.16; 179/114 R

[58] Field of Search ..... 84/1.14, 1.15, 1.16; 335/303; 310/25, 155; 179/114 M, 1 M, 114 R

[56] References Cited

U.S. PATENT DOCUMENTS 3,041,483 6/1962 Ebbinghaus et al. ..... 310/155

FOREIGN PATENT DOCUMENTS 608559 1/1935 Fed. Rep. of Germany ..... 84/1.15

1396824 6/1975 United Kingdom ..... 84/1.15

*Primary Examiner*—Gene Z. Rubinson

*Assistant Examiner*—Forester W. Isen

*Attorney, Agent, or Firm*—Auslander, Thomas & Morrison

[57] ABSTRACT

An electromagnetic pickup device for stringed musical instruments using metallic strings has a planar permanent magnet with one of its two main surfaces exposed for facing the instrument strings during use and a pickup coil mounted on the other main surface with the plane of the planar magnet perpendicular to the axis of the coil.

10 Claims, 7 Drawing Figures

FIG. 4
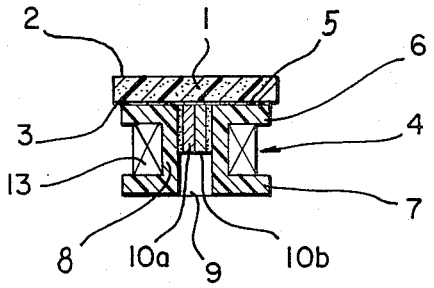
FIG. 7
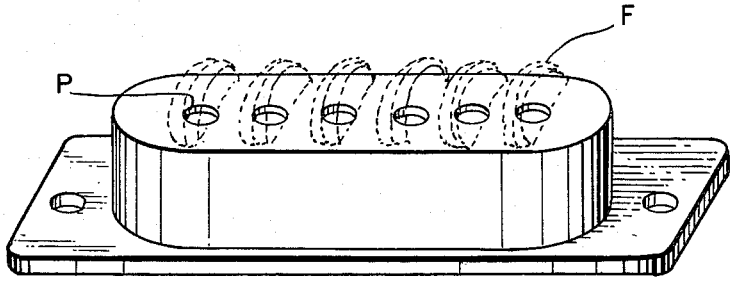
PRIOR ART
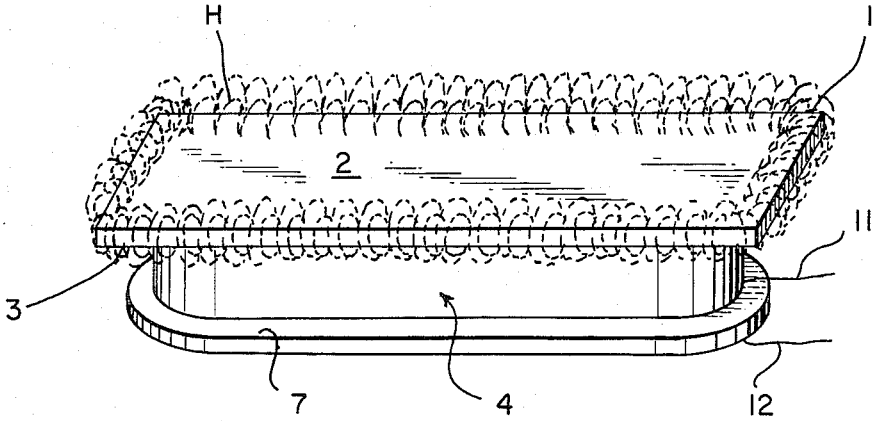
FIG. 6

ELECTROMAGNETIC PICKUP DEVICE

BACKGROUND OF INVENTION

The present invention relates to an electromagnetic pickup device for a stringed musical instrument and the like wherein a vibrated string of magnetizable material disturbs the magnetic field of a permanent magnet which induces an electromotive force in a coil for later amplification and acoustic transduction.

In known electromagnetic pickups, such as those disclosed in U.S. Pat. Nos. 2,896,491, 2,909,092, 2,968,204, 2,976,755, 3,236,930, 3,290,424, 3,535,968, 3,588,311, 4,026,178 and 4,133,243, a plurality of coil pole pieces, which are in contact with a permanent magnet, each have an end portion facing one string of a musical instrument. The disadvantages of this type of pickup device is that the magnetically active area for coacting with the strings is very small and the output of the device is extremely sensitive to the position thereof relative to the strings.

In U.S. Pat. Nos. 3,657,461 and 4,050,341, pickup devices are disclosed wherein a simple pole piece is used which is surrounded by a coil and has insulating layers thereover. The disadvantages of these types of devices is that although they are less position sensitive, the magnetically active area is still small, resulting in weak signals for amplification. Such devices of the past have also been complex to construct and require the labor and material necessary to provide the individual pole pieces. Where longitudinal bars have been provided, they have been limited to sizes to fit internal of the windings of the coils of the pick up.

SUMMARY OF THE INVENTION

The main object of the present invention is to eliminate the disadvantage of the prior art electromagnetic pickup devices, and to provide a simple magnetically sensitive plastic magnet on top of the coil which is sensitive to the vibrating strings and yet inexpensive and simple to manufacture.

This and other objects of the present invention are obtained by the electromagnetic pickup device according to the present invention, which comprises a planar permanent magnet having one of its two main faces exposed for facing the instrument strings during use and means mounted on the other main surface and coactive with the planar magnet for generating an electromotive force in response to a distortion of the magnetic field of the planar magnet by the strings.

In a preferred embodiment the planar magnet comprises non-metallic material, preferably Plastiform$^{tm}$, which is magnetized throughout the thickness thereof between the two main surfaces. Moreover, the use of a Plastiform$^{tm}$ planar magnet is particularly advantageous since it is extremely cost efficient and is composed of non-strategic materials.

In another preferred embodiment the means includes a coil wound around a plastic coil form which has a central axially extending slot therein, which in a preferred embodiment has a magnetizable core element therein in contact with the other main surface of the planar magnet. The function of the core is to favorably direct the magnet field into a "W" shape, causing a large part of the magnetic flux to pass through the coil, thereby producing the maximum possible electromagnetic force in the windings due to the interaction between them and the vibrating strings, to obtain a more effective utilization thereof.

The advantages of the present invention result from the unique juxtaposition of the permanent magnet with respect to the pickup coil, which has heretofore never been suggested or disclosed and which enables the use of a thin planar permanent magnet, something that was not thought to be acceptable to those skilled in the art.

The most important advantage of the device of the present invention is its insensitivity to positioning during use. It is well known that when a pickup device is to be installed in a guitar, selecting the correct position of the pickup device with respect to distance from the bridge is extremely critical. This results from the fact that the vibratory nodes and antinodes on the strings are highly localized because of the nature of a vibrating string, when the string is acoustically and mechanically coupled with a resonant body such as a modern guitar body, the vibratory nodes and antinodes associated with the various resonances are many and complex.

The typical modern guitar pickup device, because of its inherent design limitations, has a very small magnetically active area, usually a total of 0.166 square inches or less. Thus, moving the typical guitar pickup device slightly with respect to the bridge of the guitar has a pronounced effect upon the overtones that are seen by the magnetically active area of the device. In fact, there is a possibility of locating the device at a vibrationally dead area under the strings.

In the pickup device of the present invention, there is a much larger magnetically active area due to its unique design, i.e., approximately 1.970 square inches. Because of this larger area and the large uniform magnetic field generated thereby, the placement of the pickup device with respect to the guitar bridge is much less critical and the possibility of locating the pickup device at a vibrationally dead area under the strings is remote. Such a large and uniform magnetic field has only been heretofore made possible by elaborate and expensive systems of magnets and pole pieces.

Another advantage of the present invention is the versatility it allows the musician. Much of modern guitar playing involves "bending" of notes, which is accomplished by the musicians by applying force on a string at any location long the fingerboard in a direction perpendicular to the axis of the string and parallel to the frets. The desirable effect of this procedure is an increase of the tension on the string with a concomitant change in pitch. However, with a typical pickup device, when the string is forced away from its normal resting axis, the string goes out of alignment with the magnetic field, resulting in less effective inductive coupling between the string and the pickup device and therefore an undesirable decreased output from the pickup device.

This effect is nonexistent with the pickup device of the present invention because the magnetic field over the pickup device does not vary in the area of interest perpendicular to the axis of the strings and parallel to the frets.

Finally, an important advantage obtained by the present invention is the purity of sound reproduction obtained thereby. In a typical guitar pickup device the magnetic field strength can exceed 1,000 gauss, since a high field strength is considered necessary to achieve the required level of induced EMF in the pickup coil. This is necessitated in part by the arrangement of the magnetic material within the core of the coil in the prior art devices. As a result, the windings near the core of the coil are affected more by the magnetic field associated with the pickup device/string system than are the windings toward the outside of the coil.

The strong magnetic field over the typical pickup device in the vicinity of a string can have the effect of damping certain vibrational overtones of the string in the vicinity of the pickup device through the hysteresis effect. This is undesirable, since the resulting note sounds out of tune.

In the present invention, the maximum field strength is much less, i.e., on the order of 250 gauss. Therefore, the damping effect on the strings associated with the device of the present invention is much less and notes have a greater tendency to sound in tune. Moreover, the induced EMF is not significantly reduced from the reduced field strength, due to the novel arrangement of the planar permanent magnetic perpendicular to the axis of the coil and superposed on the coil, which results in an effective utilization of all of the windings in the coil without regard to the distance of the winding from the core of the coil. The device of the present invention therefore produces a greater induced EMF per unit of magnetic field strength than any other previously available pickup device.

Although such novel feature or features believed to be characteristic of the invention are pointed out in the claims, the invention and the manner in which it may be carried out, may be further understood by reference to the description following and the accompanying drawings.

BRIEF DESCRIPTION OF THE DRAWINGS

FIG. 4 is a sectional view along line IV—IV of FIG. 2.

FIG. 6 is a perspective view of the embodiment of FIG. 1 showing lines of magnetic force.

FIG. 7 is a perspective view of a prior art device showing lines of magnetic force.

DETAILED DESCRIPTION OF THE INVENTION

Figure 1:
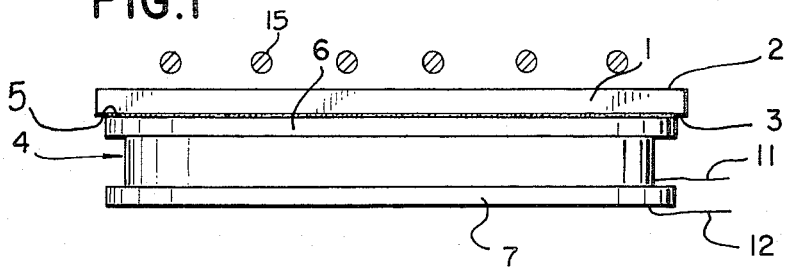
FIG. 1 is a side view of one embodiment of the present invention.
Figure 2:
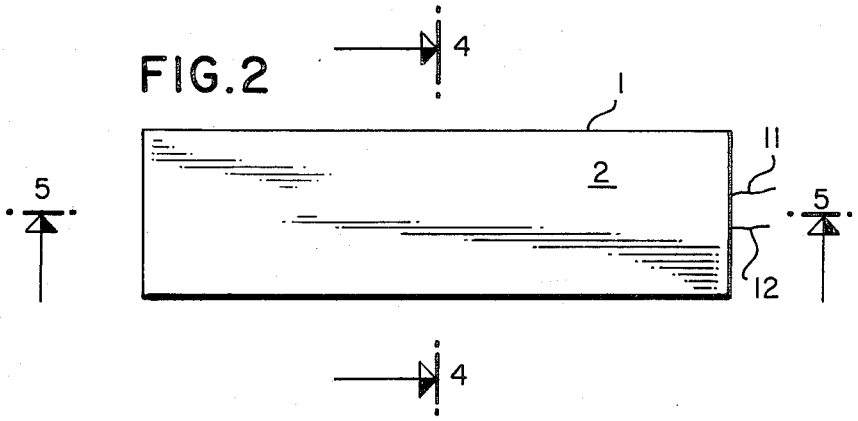
FIG. 2 is a top view of the embodiment of FIG. 1.

Referring now to the figures in greater detail, where like reference numbers denote like parts in the various figures.

In FIGS. 1–5, the pickup device of the present invention is shown, by way of example, including planar permanent magnet 1 and the means including elements 4–13 coactive therewith for producing an amplifier EMF in response to a vibration of a musical instrument string.

The planar permanent magnet 1 has two main surfaces 2, 3, of which surface 2 faces the instrument strings 15 during use and is fully exposed thereto. On surface 3, the aforementioned means are mounted by a suitable adhesive 5 or the like, such as an epoxy resin.

The means as shown includes a coil form 4 having an axially extending body portion 8 around which coil 13 of conductive wire is wound, having leads 11 and 12 extending therefrom.

The coil form 4 also advantageously includes radially extending flange portions 6 and 7, portion 6 acting to separate the coil 13 from planar magnet 1. Since the coil form comprises insulating material, preferably plastic, and is preferably an integral body, the portion 6 also acts to insulate the coil winding 13 from the planar magnet 1.

It can be clearly seen from the figures that the plane of magnet 1 is disposed perpendicular to the axis of coil 13 and that the perimetric extent of the planar magnet 1 is such to at least completely overlay the circumferential extent of the coil 13.

It is also preferably advantageous to provide the body portion 8 with an axial slot 9 centrally located therein for receiving a core element 10*a*, 10*b* therein. While it has been found that favorable results can be obtained without the core element, the core element has been found to influence results in shaping of the magnetic field pattern above the surface 2 of planar magnet 1 and in influencing the induced EMF in the coil 13.

Figure 3:
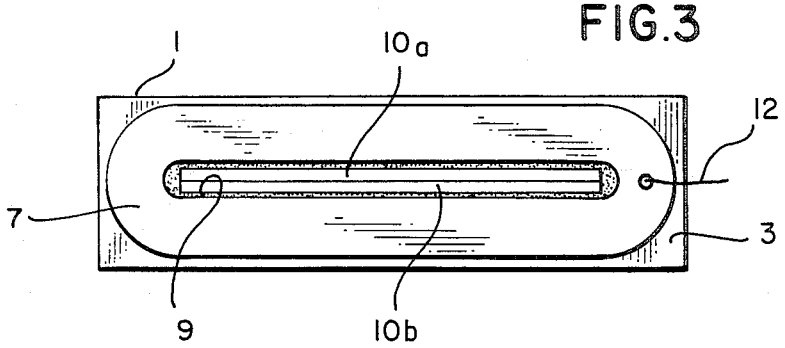
FIG. 3 is a bottom view of the embodiment of FIG. 1.
Figure 5:
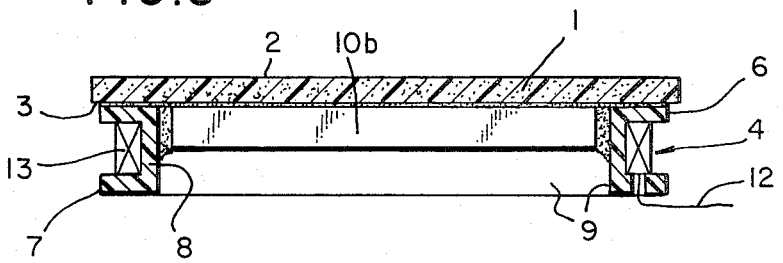
FIG. 5 is a sectional view along line V—V of FIG. 2.

In a particularly advantageous embodiment, shown in FIGS. 3–5, the core element comprises two steel bars 10*a*, 10*b* which abut against surface 3 at one side and terminate at or before the end of cavity 9, preferably at the middle thereof. The core elements 10*a*, 10*b* are held in place by a suitable adhesive such as an epoxy resin.

In an example of the device of the present invention, magnet 1 is approximately 2.625 inches long, 0.750 inches wide and 0.090 inches thick and is composed of Plastiform$^{tm}$ magnetized through its thickness and commercially available from the 3M Company. The coil form 4 is approximately 2.600 inches long, 0.685 inches wide and 0.375 inches thick. The slot 9 measures approximately 2.095 inches long, 0.187 inches wide and 0.375 inches thick. The core elements 10*a*, 10*b* each measures approximately 2.015 inches long, 0.085 inches wide (for a total width of 0.170 inches) and 0.200 inches thick.

Referring now to FIGS. 6 and 7, the above described exemplary device according to the present invention has a total magnetically active area, as shown in FIG. 6, of approximately 1.970 square inches, compared to a total of 0.166 square inches for pole pieces P in the typical prior art device shown in FIG. 7.

Also clearly shown in FIGS. 6 and 7 is the difference between the magnetic fields created by the two devices. The magnetic field lines F of the prior art are concentrated over the individual pole pieces P so that the resultant overall magnetic field is not uniform. In the device according to the present invention, the magnetic field lines H extend along the entire length of the magnet and are uniformly disposed, resulting in the many advantages set forth hereinbefore.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A stringed musical instrument having metallic strings and an electromagnetic pickup device mounted on said musical instrument, comprising:

a planar permanent magnet in said pickup device having first and second parallel opposed main surfaces;

said first main surface having a first magnetic polarity;

said first main surface being disposed facing said metallic strings;

said second main surface facing away from said strings and having a second magnetic polarity; and means mounted on said second main surface of the permanent magnet and coactive therewith for generating an electromotive force in response to a disturbance of the magnetic field of the planar permanent magnet by motion of the metallic strings facing said first main surface, said means lying entirely on one side of a plane containing said second surface.

2. The instrument according to claim 1, wherein the generating means comprises a coil of conductive wire having its axis perpendicular to the plane of the planar permanent magnet and means insulating the planar permanent magnet from the coil.

3. The instrument according to claim 2, wherein the insulating means comprises a non-conductive coil form having an axially extending body portion around which the coil is wound and at least one radially outwardly extending flange portion mounted to said second main surface.

4. The instrument according to claim 3, wherein the axially extending body portion includes means forming a central axially extending slot therein and wherein the generating means further comprises a core of magnetizable material mounted in the slot abutting said second main surface of the planar permanent magnet and extending over only a portion of the axial extent of the coil.

5. The instrument according to claim 4, wherein said core comprises two parallel elongated steel bars.

6. The instrument according to claim 3, wherein said coil form includes a radially outwardly extending flange portion at each end of the body portion.

7. The instrument according to claim 6, wherein the coil form comprises plastic material.

8. The instrument according to claim 2, wherein the permanent magnet is configured to overlay the entire area of the coil.

9. The instrument according to claim 1, wherein the exposed first main surface is continuous and uninterrupted over its entire area.

10. The instrument according to claim 2, wherein the planar permanent magnet comprises non-metallic material.

* * * * *